US005272384A

United States Patent [19]

Kochert

[11] Patent Number: 5,272,384

[45] Date of Patent: Dec. 21, 1993

[54] DIFFERENTIAL PRESSURE SWITCH SENSOR CONTROL UNIT

[75] Inventor: Vincent Kochert, Greenville, Ky.

[73] Assignee: Texas Instruments Incorporated, Dallas, Tex.

[21] Appl. No.: 451,327

[22] Filed: Dec. 19, 1989

[51] Int. Cl.[5] ..... H01H 35/00; H01H 47/00

[52] U.S. Cl. ..... 307/116; 361/147; 361/170; 361/189

[58] Field of Search ..... 361/22, 147, 170, 178, 361/189, 160, 166, 169.1, 190, 191, 194, 206; 307/116, 118

[56] References Cited

U.S. PATENT DOCUMENTS 4,324.268 4/1982 Jacobson ..... 137/312

*Primary Examiner*—A. D. Pellinen
*Assistant Examiner*—Fritz M. Fleming
*Attorney, Agent, or Firm*—Russell E. Baumann; Richard L. Donaldson; Rene' E. Grossman

[57] ABSTRACT

A control unit for DPS sensors wherein reset is obtainable only by operation of a reset mechanism with reset taking place only after the reset mechanism has been returned at least in part to its original position to avoid the possibility of reset by holding down the reset mechanism. This is accomplished by providing a compressor which is powered through a contactor and a further serially connected switch. A parameter of the compressor is monitored with the parameter value being evaluated in a counter and control circuit, the latter operating in accordance with a predetermined function to determine when an alarm condition has been sensed. When the alarm condition is reached, a control circuit including a latching relay is closed to energize the relay and thereby latch open the contacts of the contactor to remove power from the system being controlled. For reset, a reset mechanism in the form of a permanent magnet is moved into position to demagnetize the core of the relay and permit the contactor contacts to return to their normally closed state. Also, prior to demagnetization of the core, movement of the reset mechanism toward the relay causes the further serially connected switch in the circuit of the system to be controlled to open and remain open until after closure of the contacts of the contactor. This avoids the possibility that the circuit to the system to be controlled be completed by mere holding down of the reset mechanism.

8 Claims, 1 Drawing Sheet

DIFFERENTIAL PRESSURE SWITCH SENSOR CONTROL UNIT

BACKGROUND OF THE INVENTION

1. Field of the Invention

This invention relates to a control unit for a differential pressure switch (DPS) sensor and, more specifically, to such a control unit with a trip free, tamper proof magnetic reset.

2. Brief Description of the Prior Art

In general, control units for DPS sensors control the time duration that an improper condition, such as, for example, low pressure, can exist before the normally closed output contacts of the control unit are opened. Under normal operation, a motor contactor will be controlled by the control unit and will receive power while the output contacts are closed. This control unit must remain in the tripped condition (normally closed contacts open) until it is reset by some outside action, such as the pressing of a reset button.

Many control devices may be connected to the motor contactor in the same fashion as the DPS sensing control unit. Furthermore, all such serially connected controls must receive their power from the control lines of the contactor (in contrast to the motor, which receives its power from the contacts of the contactor). Thus, whenever any of these serially connected control units, including the DPS sensing control itself, opens its normally closed output contact, power is removed from the DPS control unit. THE DPS sensing control must remain in its tripped position until reset, even if power is removed and reapplied, for safety reasons. This implies the need for the DPS control to have retention or memory of the tripped condition. The DPS sensing control must also be resettable without power applied thereto. Otherwise, all serially connected controls would have to be reset before resetting of the DPS control unit. Finally, for better protection/safety, a DPS control unit must eliminate the possibility of tampering with the reset mechanism to make the normally closed contacts stay closed.

Prior art for DPS sensing control utilized capacitors to retain the tripped information or batteries. Still another prior art means of retaining the tripped data was to store the energy in a snap acting bimetal disc. Some other methods required that power not be removed from the DPS sensing control following a trip condition. The problem with batteries is their short life at high temperatures. Capacitors, on the other hand, can store energy for only a short period of time. In addition, bimetal devices are prone to variations in supplied power and require a delay time before they may be reset. Almost all of the prior art devices use a reset button, however none incorporate any antitampering techniques.

SUMMARY OF THE INVENTION

In accordance with the present invention, the above noted problems of the prior art are minimized and there is provided a control unit for DPS sensors wherein reset is obtainable only by operation of a reset mechanism, preferably a manually operated reset mechanism, with reset taking place only after the reset mechanism has been returned at least in part to its original position, thereby avoiding the possibility of reset by holding down the reset mechanism. The present invention utilizes magnetics to store the tripped information and uses a permanent magnet to perform resets, thus no power is required to perform the reset. Further, the present invention is not temperature sensitive as is the bimetal disc based DPS control. The present invention, by utilizing a digital counting scheme and a latching relay, eliminates the problems in bimetal devices (i.e., power supply variations do not affect timing and the control may be reset immediately following a trip). In addition, if the reset button is pressed, the normally closed contacts will be held open (regardless of power being applied to the device or not) by a normally closed switch serially connected to the normally closed contact of the output. When the reset button is pressed, the switch contacts open and the normally closed output of the control opens (the latching relay's normally closed contacts will be closed due to the magnetic reset).

Briefly, the above is accomplished by providing a compressor or other system to be controlled which is powered through a contactor and a further serially connected switch. A parameter of the system is monitored, such as, for example, oil pressure in a compressor, with the parameter value being evaluated in a counter and control circuit. The counter and control circuit operates in accordance with a predetermined function to determine when an alarm condition has been sensed as a function of the parameter being evaluated. The counter and control circuit basically consists of a time base generator and a counter which may be selected to count up or down. The time base generator, in general, derives it timing from the 60 Hz (120 VAC) line frequency. However, the timing may also be based upon a crystal oscillator or an R-C oscillator. The main purpose of the time base generator is to provide a stable accurate measure of time. The counter is connected so that, whenever the differential pressure sensor's contacts are open, the amount of time (from the time base generator) the contacts are open is accumulated (counting up). Whenever the contacts of the DPS are closed, time is subtracted from the accumulated value (counting down). If the accumulated time the contacts are open reaches some predetermined amount, an alarm condition is set. When the alarm condition is reached, a control circuit including a latching relay is closed to energize the alarm and simultaneously open and latch the contacts of the contactor in the open state, thereby removing power from the system being controlled. For reset, a reset mechanism in the form of a permanent magnet is moved into position to demagnetize the core of the relay and permit the contactor contacts to return to their normally closed state. Also, prior to demagnetization of the core, movement of the reset mechanism toward the relay causes the further serially connected switch in the circuit of the system to be controlled to open and remain open until after closure of the contacts of the contactor. This avoids the possibility that the circuit to the system to be controlled be completed by mere holding down of the reset mechanism. Since the latching relay is reset with a permanent magnet, it is obvious that the control may be reset even when no power is applied to the control. In addition, the serially connected switch insures that the motor will not be energized should the reset button be tampered with (i.e., if the button is "tied down" in the reset position).

DESCRIPTION OF THE PREFERRED EMBODIMENT

Figure 1:
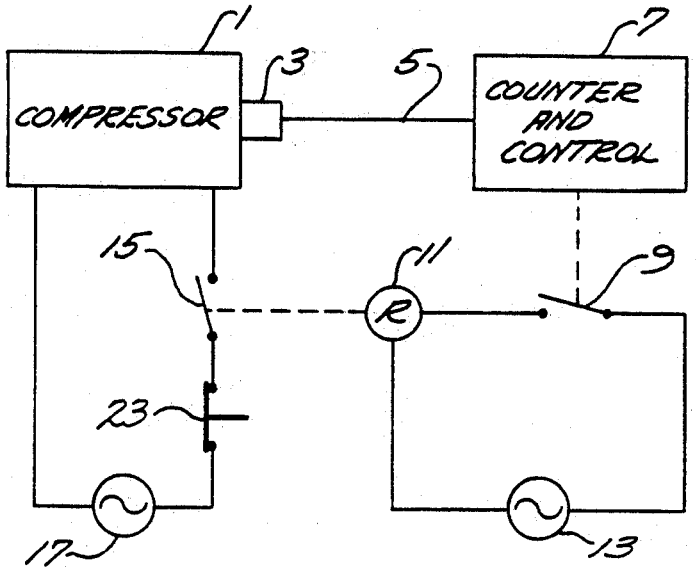
FIG. 1 is a block diagram of a compressor and control circuit in accordance with the present invention.

Referring first to FIG. 1, there is shown a schematic diagram of a differential pressure switch sensor control unit controlling operation of a compressor in accordance with the present invention. The system includes circuitry for control of a compressor 1 in response to a sensed oil pressure therein. The system comprises a pressure sensor 3 measuring the pressure in the oil line in the compressor 1. The sensed pressure is fed via a line 5 to a counter and control circuit 7 wherein the sensed pressure is categorized as to value and time in accordance with a predetermined function to increment or decrement a counter until some predetermined alarm value is reached to indicate a low pressure alarm condition. When this predetermined alarm value has been counted, the counter and control circuit 7 causes the switch 9 to close and energize the latching relay 11 via power source 13. The latching relay is preferably an Omron #G2RU-117P-V-USDFC12. The relay 11 latches in the energized condition and opens the contacts 31, 33 (FIG. 2) of the normally closed contactor 15 to cut off power from the power source 17 to the compressor 1. The compressor circuit also includes a normally closed switch 23 for opening the compressor circuit as will be discussed hereinbelow.

Figure 2:
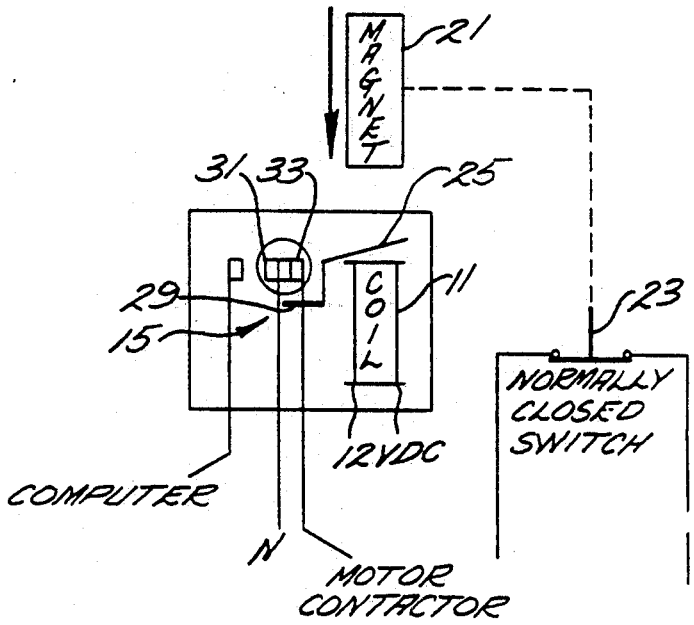
FIG. 2 is a schematic diagram of a control unit in accordance with the present invention.

Referring now to FIG. 2, there is shown a schematic diagram of the relay 11 of FIG. 1 with reset mechanism 21 which serves the function of resetting the relay 11 as well as opening the normally closed switch 23 of FIG. 1. As can be seen in FIG. 2, the reset mechanism 21 comprises a permanent magnet which is moved to a position sufficiently close to and above the core of the relay 11 to demagnetize the core of the relay and permit the armature 25 thereof to return t its original position and permit the contacts 31, 33 of the contactor 15 to close. The switch 23 is linked to the reset mechanism 21 and travels therewith, the switch 23 being opened by the travel of the reset mechanism toward the relay 11 so that the switch 23 opens before the relay has been reset. Accordingly, when the relay 11 is reset, causing the armature 25 to rotate in a counterclockwise direction and permit the contacts 31, 33 of the contactor 15 to close, the switch 23 will maintain the circuit to the compressor 1 open. Upon release of the reset mechanism 21, whereby the reset mechanism returns to its original position remote from the relay 11, the switch 23 returns to its normally closed condition and permits power to be applied to the compressor 1. In this way, a condition of operation by holding down of the reset mechanism 21 will not permit power to be applied to the compressor 1. Only after the reset mechanism 21 has been released will power be available to the compressor 1.

In normal operation, with reference to FIG. 1, switches 15 and 23 are closed and power from the power source 17 is applied to the compressor 1. During operation of the compressor 1, the pressure sensor 3 senses the oil pressure in the compressor 1 and provides a reading of that pressure along the line 5 to a counter and control circuit 7. The counter and control circuit 7, analyzes the pressure sensed at the compressor 1 as a function of time in accordance with a predetermined function. In the preferred embodiment, if a continuous low pressure condition is sensed for (a) 110 seconds for 60 Hertz or (b) 133 seconds at 50 Hertz or (c) fifty percent of the time for 425 seconds or less at 60 Hertz or (d) for 40 percent of the total time duty cycle for 720 seconds or less at 60 Hertz or (e) if power is removed from the unit for at least 60 seconds, the switch 9 is closed by the counter and control circuit 7 to complete the circuit including relay 11 and power source 13. This causes the latching relay 11 to rotate the armature 25 about its pivot in a clockwise direction and causes the transfer pin portion 29 thereof to move against the contact 31 of contactor 15 and separate the contacts 31 and 33 thereof. This opens the contactor 15 and cuts off power to the compressor 1. The relay 11 remains in the latched position and maintains the contacts 31 and 33 of the contactor 15 in the open state.

In order to reset the system, the reset mechanism 21 is moved toward the relay 11, thereby moving the switch mechanism 23 along therewith and causing the switch 23 to open prior to resetting of the relay 11. Finally, after the switch 23 has opened, the reset mechanism 21 is positioned sufficiently close to the core of the relay 11 to demagnetize the core thereof and permit the armature 25 to rotate back in a counterclockwise direction under spring actuation to permit the contacts 31 and 33 of the contactor 15 to close. At this time, the switch 23 is still open. Upon release of the reset mechanism 21, this mechanism will move away from the relay 11 and permit the normally closed switch 23 to again close, thereby permitting power to be applied to the compressor 1.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations an modifications.

I claim:

1. A control device which comprises:

(a) controlled system;

(b) a power source for powering said controlled system;

(c) first and a second switches connected in series and serially connected to said system and said power source;

(d) monitoring means for monitoring a predetermined condition at said controlled system;

(e) means responsive to a predetermined condition monitored by said monitoring means to latchingly open said first switch; and (f) reset means including a magnet to cause closing of said first switch and control means to control operation of said second switch to cause opening of said second switch, then closing of said first stitch and then closing of said second switch.

2. A control device which comprises:

(a) a controlled system;

(b) a power source for powering said controlled system;

(c) first and second normally closed switches connected in series and serially connected to said system and said power source;

(d) monitoring means for monitoring a predetermined condition at said controlled system;
(e) means responsive to a predetermined condition monitored by said monitoring means to latchingly open said first switch; and
(f) reset means including a magnet to cause closing of said first switch and control means to control operation of said second switch to cause opening of said second switch, then closing of said first switch and then closing of said second switch.

3. A control device which comprises:
(a) a controlled system;
(b) a power source of powering said controlled system;
(c) first and second switches connected in series and serially connected to said system and said power source;
(d) monitoring means for monitoring a predetermined condition at said controlled system;
(e) mean including a latching relay responsive to a predetermined condition monitored by said monitoring means to latchingly open said first switch; and
(f) reset means including a magnet to cause closing of said first switch and control means to control operation of said second switch to cause opening of said second switch, then closing of said first switch and then closing of second switch.

4. A control device which comprises:
(a) controlled system;
(b) a power source for powering said controlled system;
(c) first and second normally closed switches connected in series and serially connected to said system and said power source;
(d) monitoring means for monitoring a predetermined condition at said controlled system;
(e) means including a latching relay responsive to a predetermined condition monitored by said monitoring means to latchingly open said first switch; and
(f) reset means including a magnet to cause closing of said first switch and control means to control operation of said second switch to cause opening of said second switch, then closing of said first switch and then closing of second switch.

5. A control device which comprises:
(a) a controlled system;
(b) a power source for powering said controlled system;
(c) first and second switches connected in series and serially connected to said system and said power source;
(d) monitoring means for monitoring a predetermined condition at said controlled system;
(e) means responsive to a predetermined condition monitored by said monitoring means to latchingly open said first switch; and
(f) reset means including a magnet and control means to control operation of said second switch movable toward and away from the first switch to cause opening of said second switch, then closing of said first switch and then closing of said second switch wherein said magnet is a permanent magnet.

6. A control device which comprises:
(a) a controlled system;
(b) a power source for powering said controlled system;
(c) first and second normally closed switches connected in series and serially connected to said system and said power source;
(d) monitoring means for monitoring a predetermined condition at said controlled system;
(e) means responsive to a predetermined condition monitored by said monitoring means to latchingly open said first switch; and
(f) reset means including a magnet and control means to control operation of said second switch movable toward and away from the first switch to cause opening of said second switch, then closing of said first and then closing of said second switch wherein said magnet is a permanent magnet.

7. A control device which comprises:
(a) a controlled system;
(b) a power source of repowering said controlled system;
(c) first and second switches connected in series and serially connected to said system and said power source;
(d) monitoring means for monitoring a predetermined condition at said controlled system;
(e) means including a latching relay responsive to a predetermined condition monitored by said monitoring means to latchingly open said first switch; and
(f) reset means including a magnet and control means to control operation of said second switch movable toward and away from the first switch to cause opening of said second switch, then closing of said first switch and then closing of said second switch wherein said magnet is a permanent magnet.

8. A control device which comprises:
(a) a controlled system;
(b) a power source for powering said controlled system;
(c) first and second switches connected in series and serially connected to said system and said power source;
(d) monitoring means or monitoring a predetermined condition at said controlled system;
(e) means including a latching relay responsive to a predetermined condition monitored by said monitoring means to latchingly open said first switch; and
(f) reset means including a magnet and control means to control operation of said second switch movable toward and away from the first switch to cause opening of said seocnd switch, then closing of said first switch and then closing of said second switch wherein said magnet is a permanent magnet and said first and second switches are normally closed.

* * * * *